US005603130A

United States Patent [19]

Snijders et al.

[11] Patent Number: 5,603,130

[45] Date of Patent: Feb. 18, 1997

[54] SANITARY SEAT

[75] Inventors: Christiaan J. Snijders, Wassenaar; Alphonsus M. L. D. Hoenderdos, Haarlem; Willem G. L. de Jong, Pijnacker; Adrianus P. de Jong, Delft, all of Netherlands

[73] Assignee: B.V. Optische Industrie De Oude Delft, Delft, Netherlands

[21] Appl. No.: 39,353

[22] PCT Filed: Oct. 24, 1991

[86] PCT No.: PCT/NL90/00212

§ 371 Date: Apr. 22, 1993

§ 102(e) Date: Aug. 20, 1993

[87] PCT Pub. No.: WO92/07498

PCT Pub. Date: May 14, 1992

[30] Foreign Application Priority Data

Oct. 25, 1990 [NL] Netherlands ..... 9002334

[51] Int. Cl.[6] ..... A47K 13/10

[52] U.S. Cl. ..... 4/667; 4/254; 4/444

[58] Field of Search ..... 4/254, 444, 667

[56] References Cited

U.S. PATENT DOCUMENTS

| | | | |
|---|---|---|---|
| 467,017 | 1/1892 | Olsen | 4/480 X |
| 963,538 | 7/1910 | Ford | 4/480 X |
| 4,112,524 | 9/1978 | Johansson | 4/254 X |
| 4,287,618 | 9/1981 | Silver | 4/443 |
| 5,027,446 | 7/1991 | Robertson | 4/254 |

*Primary Examiner*—Charles E. Phillips
*Attorney, Agent, or Firm*—Louis E. Marn

[57] ABSTRACT

Sanitary seat on which the disabled or the elderly can sit to wash—or have washed—parts of their lower body. The seat (61) comprises two parts, an inner part (64) and an annular part (62), which can be moved relative to each other in the vertical direction. When the inner part (64), is projecting above the annular part (62), the part of the lower body projecting outside the inner part can be washed. When the inner part (64), is below the annular part (62), the particular person is sitting on the annular part (62). In that situation the other part on which the person was first seated can be washed. The inner part (64) is preferably provided with a spray head, and the inner part (64) with a downward projecting part of the annular part (62) preferably forms a watertight seal for forming a space which can be filled with water in which the lower body can be cleansed.

5 Claims, 6 Drawing Sheets

SANITARY SEAT

Figure 1:
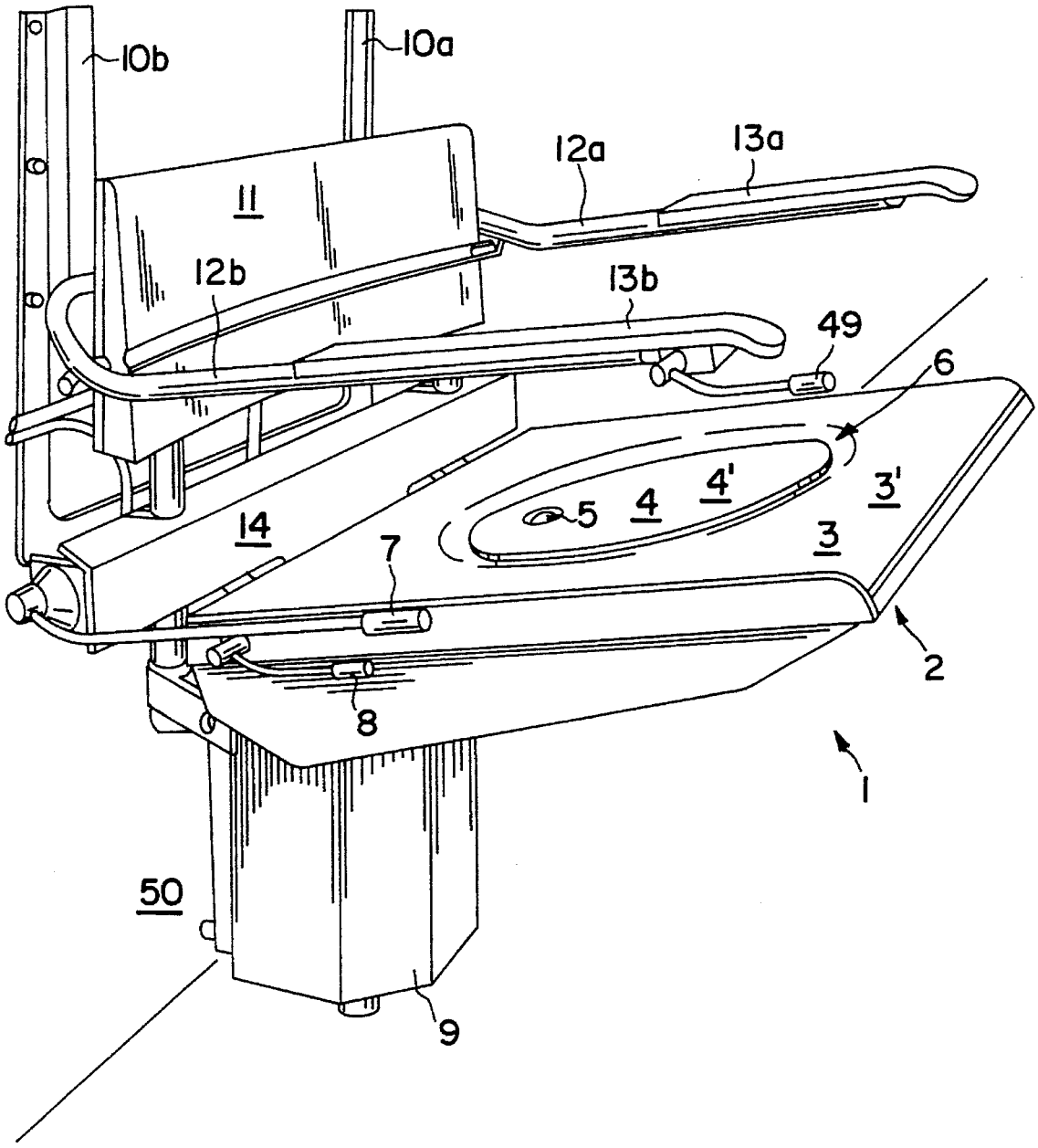

The invention relates to a sanitary seat unit for providing a sitting place while washing the lower part of the human body comprising positioning means for installing the sanitary seat unit at a place of use and a seat determining an opening.

Such a sanitary seat unit is known from U.S. Pat. No. 4,287,618. The sanitary seat unit shown therein is specifically deigned for use by individuals suffering from haemorrhoids, fissures or other ailments of the peri-anal area.

The present invention relates in particular to such a sanitary seat, on which the disabled, in particular patients with rheumatism and Parkinson's Disease, paraplegics and the like or elderly people, can sit to be able to wash—or have washed—the lower part of their body.

Disabled people generally have great difficulties in washing parts of their lower body, such as the anus, genitalia, perinaeum, buttocks, thighs, etc. During washing it is necessary for the disabled person to be seated, in order to ensure greater control of the washing actions, which he can often perform with only one hand. If a stool is being used to sit on, the presence of the seat unit constitutes a restriction in the accessibility of the parts of the body to be washed. This also applies when a bidet e.g. as shown in the abovementioned U.S. Pat. No. 4,287,618 or something similar is being used.

The object of the invention is to provide an improved sanitary seat unit which offers greater convenience for the disabled, in particular through increasing the accessibility of the parts to be washed.

For this purpose, the sanitary seat according to the invention is characterized in that the seat comprises at least first and second seat parts, the first seat part determing the opening for accommodation therein of the second seat part and in that he seat unit comprises controllable movement means for moving at least one of the seat parts in substantially the vertical direction relative to the other seat part from a position below to a position above the other seat part and vice versa.

Splitting the seat into two parts means that by moving a seat part the disabled person can cause a part of his body which is normally supported to be exposed for washing, while the other remaining part of his body takes over the supporting function. The fact that a seat part is movable means that disabled users are offered the possibility of setting the seat part in question as desired, with the result that the movements which the disabled user had to make hitherto can be reduced.

The fact that at least one seat part of the seat is movable is also very advantageous because in this way help can be provided during sitting down and getting up again, which was hitherto often a problem for the user with incomplete control of his body.

It is particularly advantageous that the second seat part is movable between a position below and a position above the first seat part. When the second seat part is raised above the first seat part, large parts of the buttocks and thighs of the user can be raised clear of the first seat part for washing, and the supporting function is simply taken over by other parts of the lower body of the user.

When the second part is sunk below the first seat part the first seat part takes over the supporting function and the peri-anal area can be washed.

According to a further development of the seat unit according to the invention, the movement means are designed for moving the second seat part between at least one position below the first seat part and a position essentially at the same height as it. In the position with the second seat part at the same height as the first seat part the user is offered a seat surface which is very comfortable (comfort seat). When the second seat part is moved below the first seat part, perinaeum, anus and genitalia become easily accessible for water, which can be applied by hand or mechanically. In this embodiment it is also advantageous if the first seat part forms part of a bowl-shaped part suitable for holding water, and the second seat part in the position below the first seat part determines a part of the bottom of the bowl-shaped part, while sealing it off. In the low position of the second seat part, a bowl of water can thus be presented to the user of the seat unit, in order to soak parts of the body, in the course of which the user can also experience a relaxing feeling. Through raising the second seat part relative to the first seat part after some time, the dirty water can simply flow away.

The second seat part is provided in an advantageous manner with elements for spraying water towards the user. With these, in the low position of the second seat part it is possible to spray directly against the parts of the user's body to be cleansed and also, if desired, to fill the bowl formed by the first seat part with water. It is also preferable for elements to be provided for moving spray elements relative to the first seat part. These elements can be formed by means for moving the second seat part up and down.

For further increased user comfort it is advantageous if the movement means are also designed for making the seat part in question tilt in the vertical plane, so that the seat can be moved into a slanting position.

The invention will now be described in greater detail with reference to a preferred embodiment, which is shown by way of example in the accompanying drawings.

Figure 2:
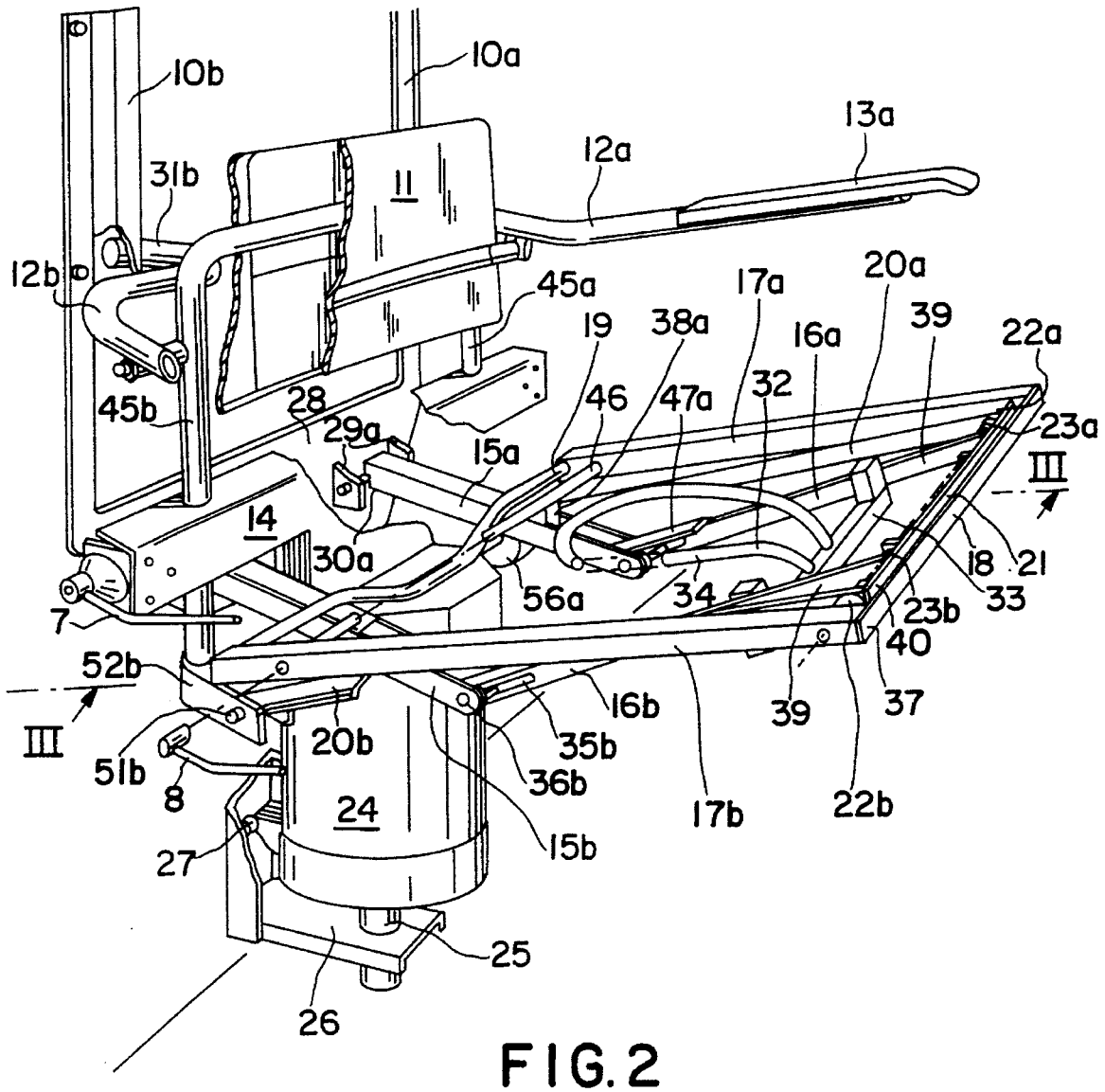
Figure 5:
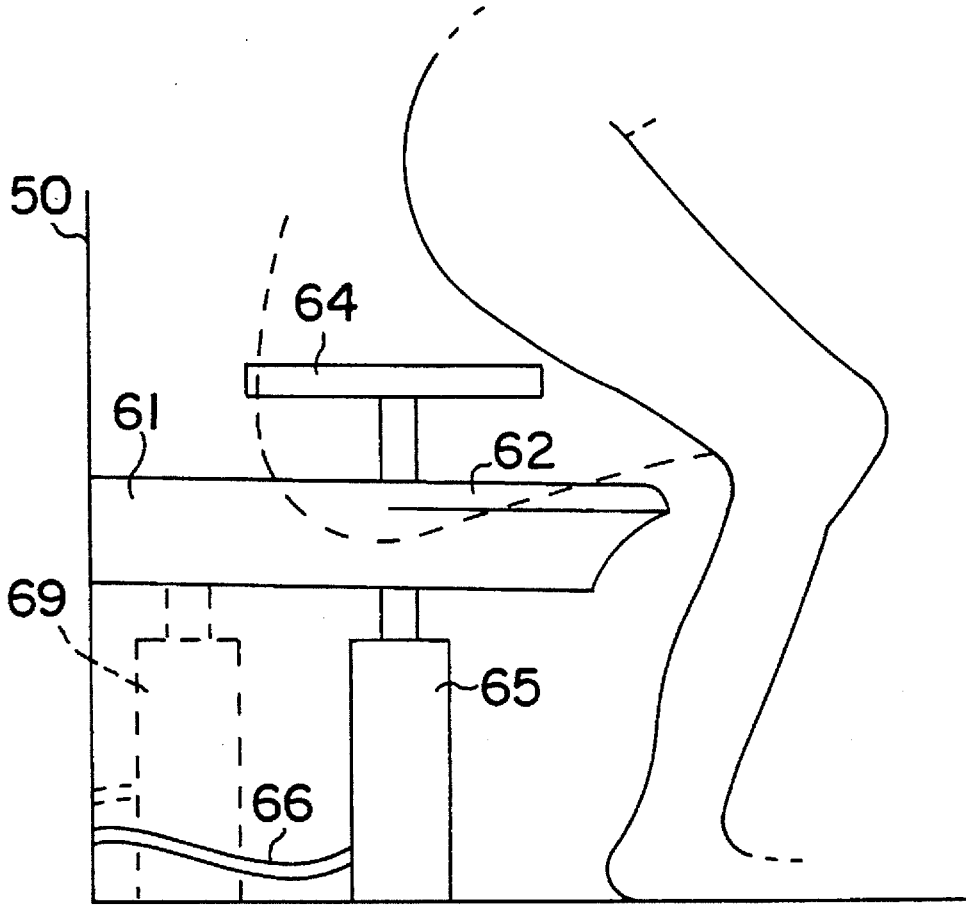

It is shown in:

FIG. 1: a sanitary seat embodying the invention for a physically handicapped person, in perspective view;

FIG. 2: the sanitary seat of FIG. 1, cut away, with the most important parts for functioning of the sanitary seat being shown;

FIGS. 3A–D: sections along line III—III in FIG. 2 of successive positions of the sanitary seat of FIGS. 1 and 2;

FIGS. 4A–D: positions of a part of the movement mechanism, corresponding to the positions of the shower seat in FIGS. 3A–D, with the surrounding parts being omitted;

FIG. 5: other embodiments of a sanitary seat according to the invention in solid and dashed lines;

FIGS. 6A—D: schematic representations of a sanitary seat according to the invention in operation.

FIG. 1 shows a sanitary seat unit 1 according to the preferred embodiment of the invention, placed in a bathroom. The sanitary seat unit 1 comprises a seat 2, composed of a virtually rectangular seat part 3 with a top surface 3' and an opening 6, and a plunger 4 which fits in the opening 6 and has a top face 4'. The seat 2 also has a housing 34 in which a large part of the movement mechanism to be described in greater detail is accommodated. The sanitary seat is also provided with a backrest 11, from which two armrests 12*a, b* provided with arm pads 13*a, b* extend forwards. The backrest 11 is connected by means of vertical tubes 45*a, b* to the rear side of the seat 2, the tubes 45*a, b* extending through a cabinet 14 in which a transmission for the lifting handle 7 to the lifting cylinder unit 24, 25 (FIG. 2) provided in the cabinet 9 is accommodated. The cabinet 14 is fixed on the cylinder 24. Guides 10*a, b* are fixed on the wall 50 of the bathroom, in which guides the guide projections 31*a, b* shown in FIG. 2 can move up and down, in conjunction with the movement of the lifting cylinder 24.

The plunger 4 is provided with a recessed spray head 5, which is connected to the water mains and can be operated by means of a spray tap handle 49. Finally, FIG. 1 also shows a locking handle 8, the function of which will be explained below.

In the cutaway illustration of FIG. 2 three supporting frames can be seen, a supporting frame 37 for the seat part 3 (FIG. 1), a supporting frame 39 for the plunger 4 (FIG. 1), and a supporting frame 40 for the seat 2 as a whole.

The supporting frame 37 comprises two parallel bars 17*a*, 17*b*, which are connected to each other at the back, i.e. at the end lying at the wall 50 of the bathroom, by a crossbar 19 forming a firm connection therewith, and at the front, i.e. at the end lying away from the wall 50, by means of a crossbar 18, which also forms a firm connection therewith. At the end lying away from the wall 50 the bars 17*a, b* are fixed at the position of 22*a, b* in a hinged manner to the supporting frame 40. The supporting frame 37 also has a crossbar 46 which is fitted near the crossbar 19 and is supported in a rotatable manner in the bars 17*a, b* and is provided with locking pins 38*a, b* firmly fixed thereto. The crossbar 46 can be rotated about its axis by operating the locking handle 8.

The supporting frame 39 comprises two parallel bar assemblies 15*a*, 16*a* and 15*b*, 16*b*, each forming an elbow joint. The bars 15*a* and 15*b* are fixed at the wall side at the position of 30*a*, 30*b* in a hinged manner to brackets 29*a, b* which themselves can be fixed by means of a plate 28 to the wall 50. Bars 16*a, b* are fixed at their end lying away from the wall 50, at the position of 23*a, b* in a hinged manner to the supporting frame 40, the central axes of the hinges 22 and 23 lying in line. The other ends of the bars 15*a, b* are provided with pins 36*a, b*, which are accommodated in longitudinal holes 35*a, b* provided in the other ends of the bars 16*a, b*. A U-bar 33 is also fixed firmly on the bars 16*a, b*, itself again forming a support for a bracket 32, on which the top plate 4' of the plunger 4 (see also FIG. 3A) is nested. At the position of the connection to the bars 15*a, b* the top side of the bars 16*a, b* is provided with stop plates 47*a, b*, against which the locking pins 38*a, b* come to rest in the manner to be explained further below.

The supporting frame 40, finally, is made up of two parallel tubes 20*a, b*, which are firmly connected to each other at the ends facing away from the wall by means of a crossbar 21, and at their ends lying at the wall 50, at the position of 52*a, b*, are in principle hingedly fixed to retaining clips 51*a, b* which are fitted on the lower ends of the tubes 45*a, b*. The ends of the tubes 20*a, b* lying at the wall are bent over, so that with the bent part they find a stop against the lower side of the tubes 45*a, b* and/or the lower side of the retaining clips 51*a, b*. The supporting frame 40 can thus be tilted up if desired, but it can also retain a fixed orientation.

Since the cabinet 14 is firmly connected here to the lifting cylinder 24, which is in turn fitted for vertical movement on piston unit 25 attached by means of footplate 26 in a fixed manner in the bathroom, vertical displacement of the cylinder 24, which is guided here by the fixed guides 27, will result in vertical displacement of the tubes 45*a, b*, the angle which the tubes 20*a, b* form with the horizontal remaining constant. It will thus be seen that on operation of the lifting cylinder 24 the piston unit 25, the footplate 26, the guides 27, the guides 10*a, b*, and the hinged connection 30*a, b* remain in place, while the supporting frame 40 retains its orientation.

The lifting cylinder 24 is also provided at its top end with bearings 56*a, b* for supporting the bars 15*a*, 15*b*. These bearings 56*a, b* are in the form of a roller here.

The shower seat described above will be explained below with reference to FIGS. 3A–D and 4A–D.

Figure 3A:
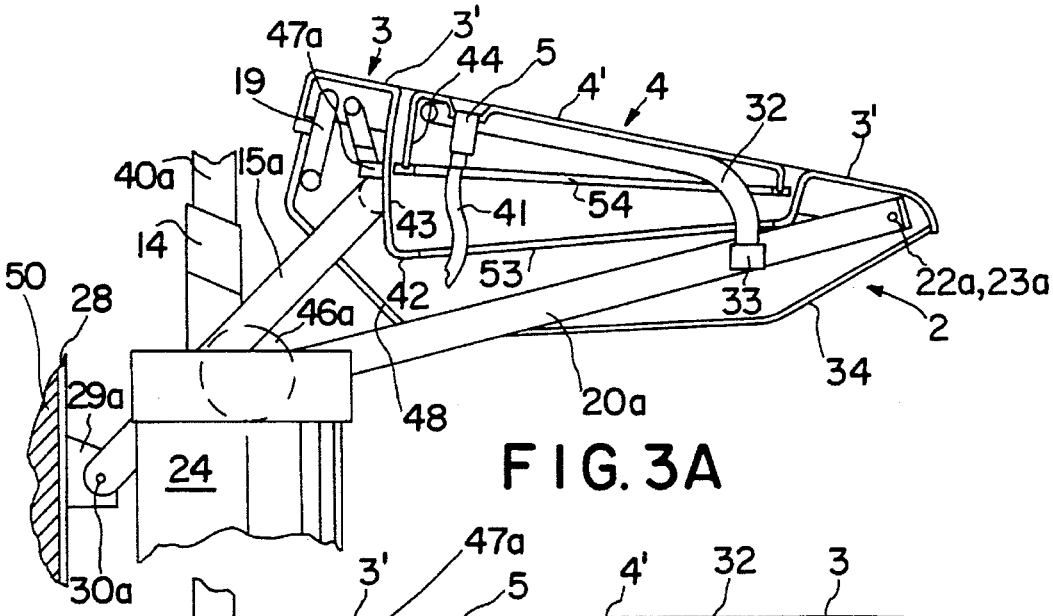
Figure 4A:
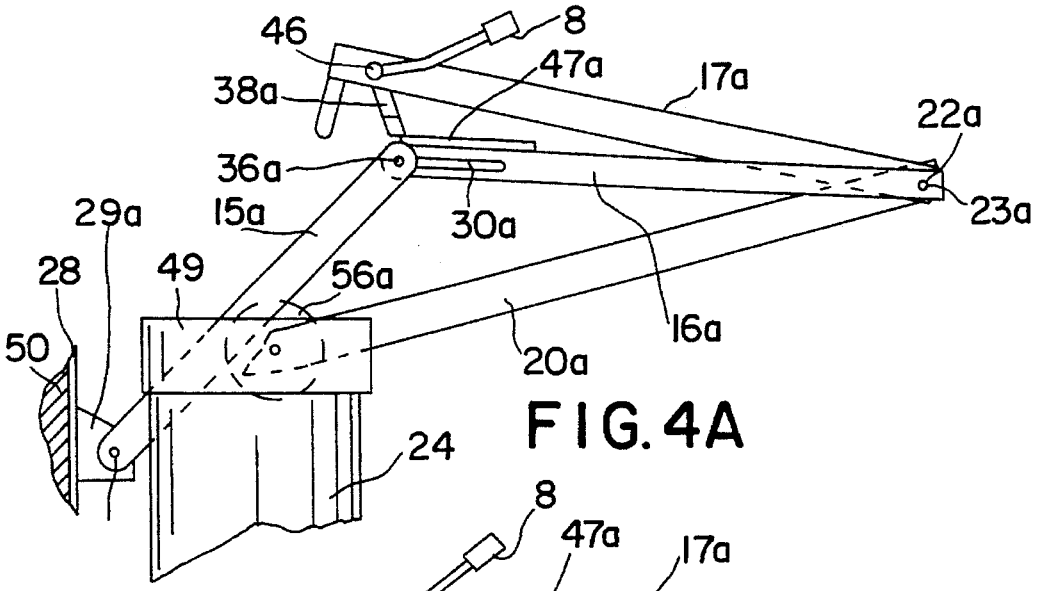

In FIG. 3A the seat 2 is in the highest position. The lifting cylinder 24 is moved to the lowest position, and thus also the cabinet 14 and the tubes 45, and therefore also the backrest 11 (FIGS. 1 and 2). Like the cylinder 24, the roller bearing 56*a* for the underside of the bar 15*a* is moved up. As can be seen in FIG. 4A, the locking handle 8 is operated to bring the locking pin 38*a* home against the appropriate stop face 47*a*. The dimensions of the locking pin 33*a* and the distance between them and the hinge joints 22*a* and 23*a* are selected in such a way that in this case the top face 4*a'* of the plunger 4 and the top face 3' of the seat part 3 provide an essentially closed sitting surface.

It can be seen that the covering 34 of the seat 2 is provided with apertures 48 for moving the parts 15*a, b*, 20*a, b*, 17*a, b* and 24.

In the position shown in FIGS. 3A and 4A, bar 15*a* is tilted so far about hinge 30*a* that the pin 36*a* of the bar 15*a* is moved against the rear end of the longitudinal hole 35*a*. With the lifting cylinder 24 locked in this position, the orientation of the tube 20*a* is also fixed, and thus also the positioning of the hinges 22*a* and 23*a*. Since the hinge 30*a* is also fixed in position, and the bar 15*a* is supported at the position of 56*a*, the position of the seat 2 is also ensured. This position is shown here in a preferred arrangement, in which the sitting surface forms an angle of approximately 12° with the horizontal and at the level of the seatbones of the user is a height of approximately 64 cm above the floor of the bathroom. This gives the user the chance to sit down in a controlled manner, without flopping down.

Figure 3B:
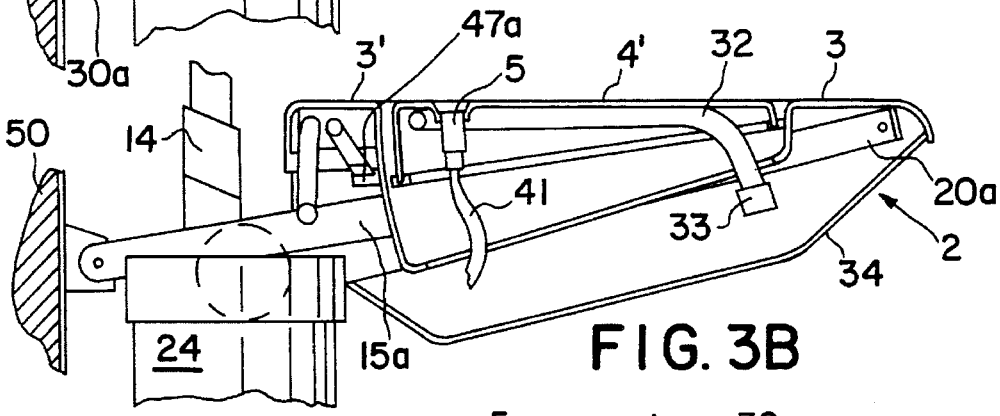
Figure 4B:
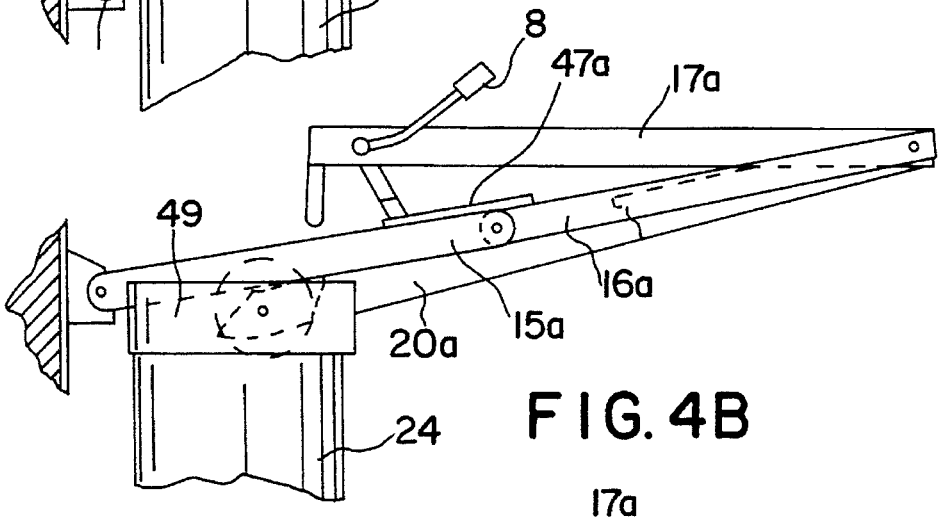

If the lifting cylinder 24 is then moved down by operating the lifting handle 7, bar 15*a* will tilt down about hinge 30*a*, and the tube 20*a* is moved downwards while retaining its orientation until, for example, the position shown in FIGS. 3B and 4B is reached. The lowering speed of the pin 36*a* is greater here than that of the hinges 22*a* and 23*a*, so that the seat angle, which initially was preferably 12°, decreases. Since the locking pin 38*a* still lies against the stop plate 47*a*, the seat part 3 follows the movement of the plunger 4. The so-called comfort position is thus reached (FIG. 3B). The essentially closed seat surface 3', 4' offered is now preferably at a height of 47 cm above the floor of the bathroom, so that water sprayed with the spray head 5 against the body can simply flow away through the annular space present between the plunger 4 and the seat part 3.

Figure 3D:
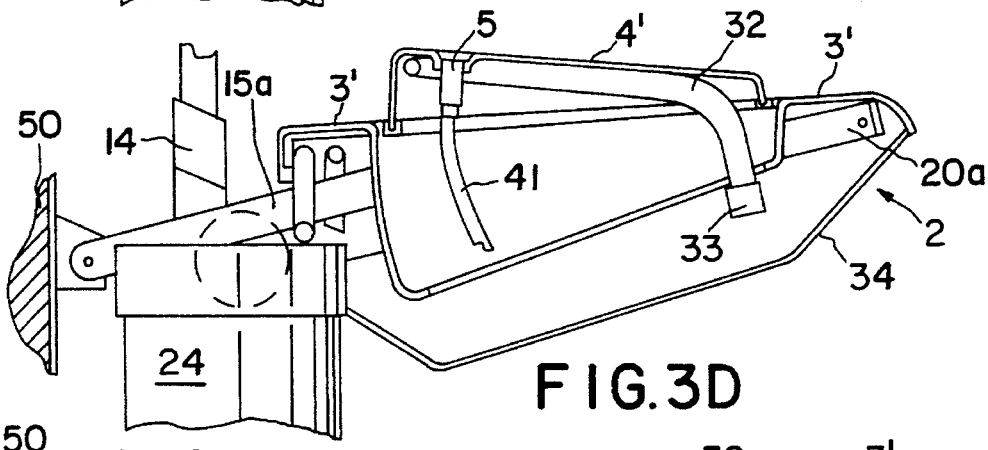
Figure 3C:
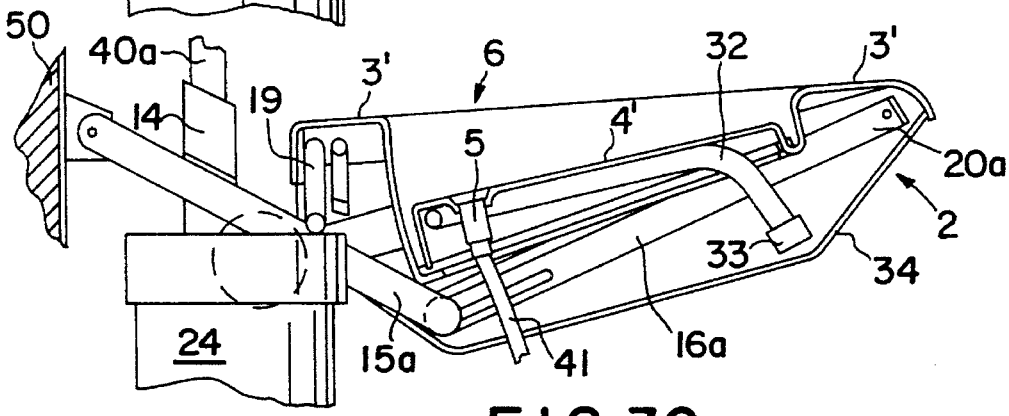
Figure 4D:
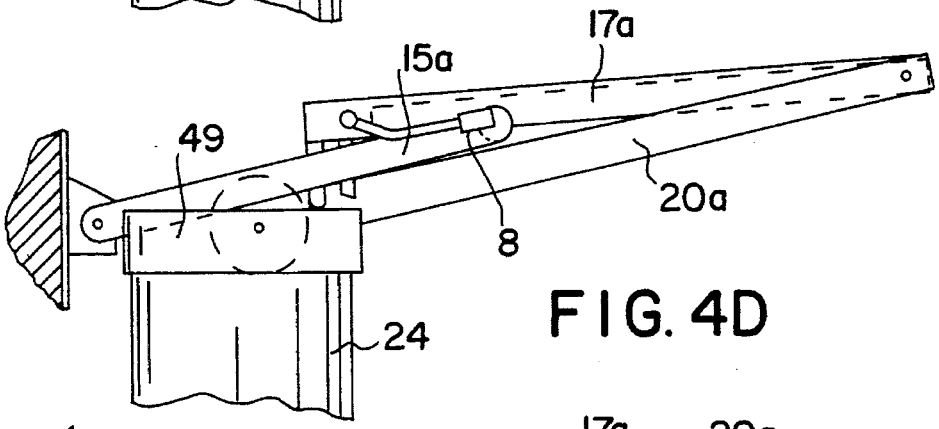
Figure 4C:
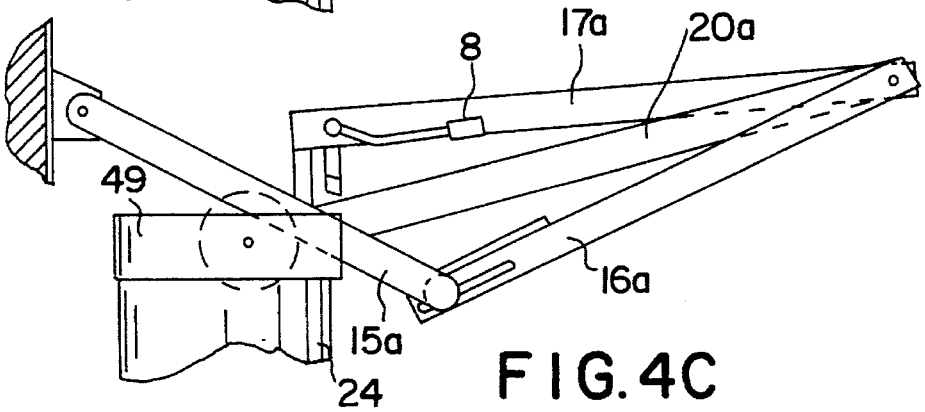

If the lifting cylinder 24 is moved further down, through relative displacement of the stop plate 47*a*, the locking pin 38*a* will go out of its range. A little later the underside of crossbar 19 of the supporting frame 37 for the seat part 3 will knock against the top surface 49 of the lifting cylinder 24. In order to ensure that the movement of the bars 15*a* and 15*b* is not impeded, the crossbar is made with a double bend. With further downward movement of the lifting cylinder 24 the pin 36*a* drops again to a greater extent than the lifting cylinder 24 itself and now also faster than the crossbar 19, and thus the seat 2. In the end, the position shown in FIGS. 3C and 4C is reached, in which the pin 36*a* again lies against the rear end of the longitudinal hole 35*a*, and the plunger 4 has moved downwards so far relative to the seat part 3 that the underside of the circular inside wall 44 thereof goes against a circular flange 42 fitted on the underside of the circular inside wall 43 of the seat part 3. A seal provided on the flange 42 or on the lower edge of the wall 44 ensures that the seat part 3 and the plunger 4 now form a reservoir into which water can be admitted through pipe 41 which is connected to the water mains and spray head 5. The pipe 41 extends to the spray head 5 through the aperture 53 determined by the flange 42 and through the open underside 54 of the plunger 4. The aperture 53 here also admits the bracket 32. It can be seen in FIG. 3C that the upper side of bar 15*a* comes to rest against the underside of the cabinet 14, which ensures that the lower edge of the wall 44 can be pressed firmly against the flange 42, in order to ensure a good seal of the reservoir.

If suitable dimensions of the opening 6 of the seat part 3 are selected, for example an oval-shaped opening with the tip forward and with a width of approximately 0.23 m and a length of approximately 0.28 m, while the height of the seat at the position of the seat bones is approximately 39 cm, and the seat angle, i.e. the angle which the top face 3' forms with the horizontal, is approximately –4°, it will generally be ensured that the seat bones of the user sink down so far that the perinaeum is opened. The spray head 5 can now also be used for spraying the area surrounding the anus during filling of the reservoir. When the reservoir is filled sufficiently, the user can remain sitting for some time, in order to let the area surrounding the anus soak in it.

If the user now raises the lifting cylinder 24 by operating the lifting handle 7 and has also pressed down the locking handle 8 here, as a result of the lever action between hinge 30 and the bearing of bar 15*a* on roller bearing 56*a*, the pin 36*a* will be moved up more quickly than the top side 49 of the lifting cylinder 24, and therefore more quickly than the crossbar 19 supported on it, and thus more quickly than the seat part 3. In the meantime, the coming away of the lower edge of the wall 44 of the plunger 4 from the flange 42 makes the reservoir run empty. The situation shown in FIGS. 3D and 4D is thus achieved. The seat angle here is still preferably approximately –4°, while the plunger 4 is now raised to a height of approximately 4 cm above the top face 3' of the seat 3, to a height of approximately 44 cm above the floor of the bathroom. In this position the user is given the opportunity of washing the parts of the body which gave support on the seat part 3 in the position of FIGS. 3C and 4C, for example by hand.

The user then lowers the lifting cylinder 24 again to the position shown in FIGS. 3C and 4C for continued cleansing, or to such a lower position that the user can operate the locking handle 8 in order to ensure that when the lifting cylinder 24 is raised again the locking pin 38*a* engages with the stop face 47*a*. This again produces an essentially closed sitting surface which is retained until in the end the position shown in FIGS. 3A and 4A has been reached. In this position the user finds a helping support for getting up. Through the selected fixing of the tubes 20*a*, 20*b*, the seat 2 can now be folded up if desired.

Figure 6A:
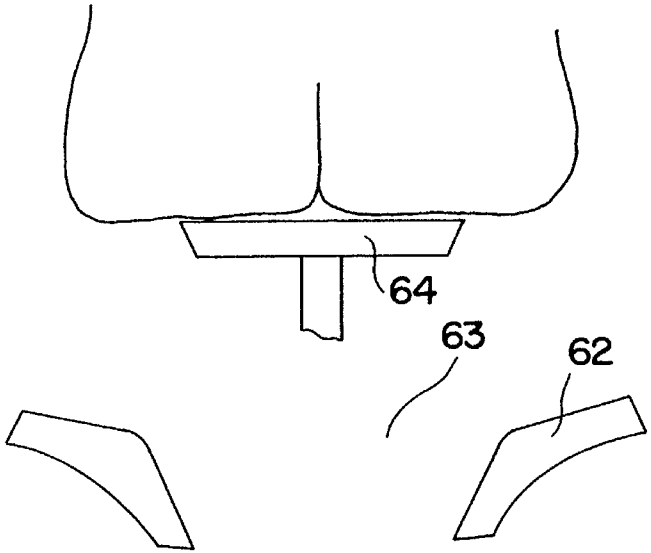

FIG. 5 shows in solid lines another embodiment of a sanitary seat according to the invention. A seat 61 is in this example fixed firmly to the wall 50. The seat 61 has an edge 62 which encloses an opening 63 (FIG. 6A). In the opening 63 a plunger 64 can be moved up and down with the aid of a lifting cylinder 65. The lifting cylinder 65 can be electrical but, given the wet environment in which it is used, it is preferably hydraulic. As in the embodiment shown in FIG. 1, the plunger 4 is provided with a spray head (not shown). A hose 66 provides the water supply to the spray head (not shown) in the plunger 64.

Figure 6B:
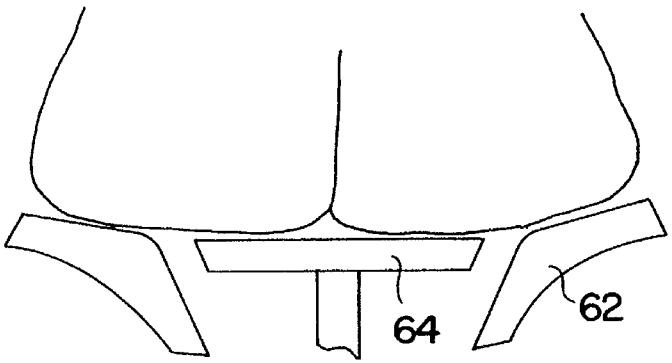
Figure 6C:
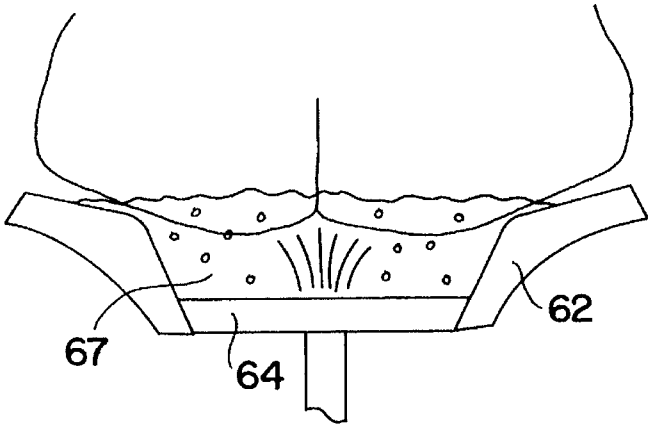
Figure 6D:
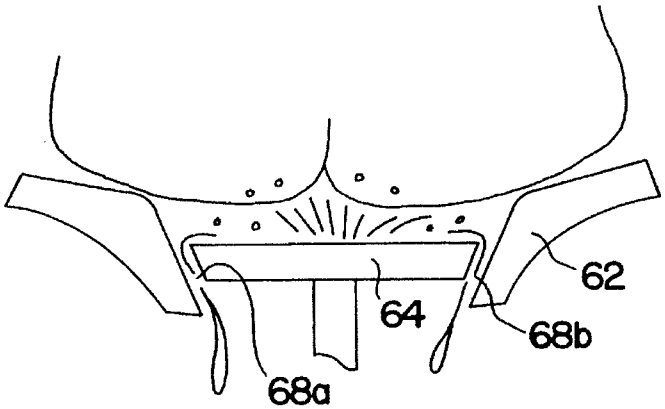

FIG. 6A shows a person 70 who has just sat down on the plunger 64. For this purpose, the plunger 64 is in a high position such as is also shown in FIG. 5. The plunger 64 can then be moved by means of the lifting cylinder 65 into a comfortable sitting position, which is shown in FIG. 6B. The top face of the plunger 64 in that position is situated at the same height as the edge 62 of the seat 61. In this position most of the body of a disabled person sitting under a shower can be washed, while the disabled person is seated in a relaxed and comfortable position. The person can then proceed to wash the lower part of the body. This is achieved by moving the plunger 64 further down into the position shown in FIG. 6C. In that position the plunger 64 connects in a sealing manner to the inside of the edge 62 and thus forms a basin 67. As soon as the plunger 64 reaches the lowest position shown in FIG. 6C, the basin can be filled by means of the spray head with water at a pleasant temperature. Dirt present on the skin is loosened in this way. In FIG. 5 the position of the disabled person at that moment is shown by the dashed line. Finally, the plunger 64 is moved up again slightly relative to the edge 62, with the result that the water present in the basin 67 can flow away through the slit indicated by 68*a* and 68*b*. The spray head is then also preferably turned on, so that the loosened dirt is simply discharged through the slits 68*a* and 68*b*. Finally, the parts of the buttocks with which the person concerned is sitting on the edge 62 are cleansed by placing the plunger 64 in a position in which the top face of plunger 64 lies higher up than the edge 62, for example as shown in a slightly exaggerated manner in FIG. 6A.

FIG. 5 shows by dashed lines yet another embodiment of a sanitary seat according to the invention. In this embodiment the seat 61 is movable in the vertical direction by means of a lifting cylinder 69 and guide grooves (not shown) in wall 50. This means that the sitting height of the sanitary seat can be adjusted as a whole in situations such as those shown in FIGS. 6B–6D. It is also possible to move from the situation shown in FIG. 6B into the situation shown in FIG. 6C by moving up the seat 61 by means of lifting cylinder 69, or through a combination of an upward movement of seat 61 and a downward movement of plunger 64. The same applies to the transition from the situation shown in FIG. 6C to the situation shown in FIG. 6D.

Although for reasons of clarity not shown explicitly in FIG. 5 and FIG. 6A, in the embodiments shown in FIGS. 5 and 6 the plunger 64 can also be made tilting, as described above, for the purpose of further increasing user comfort.

We claim:

1. A sanitary seat assembly for providing a sitting place for a human body to facilitate washing of lower parts, which comprises:

a first seat part;

a second seat part cooperating with said first seat part;

movement means for moving in a vertical direction one of said seat parts from a first position to a second position, said second seat part being positioned above said first seat part in said first position and below said first seat part in said second position;

a backrest; and armrests mounted to said backrest.

2. A sanitary seat assembly for providing a sitting place for a human body to facilitate washing of lower parts, which comprises:

a first seat part;

a second seat part cooperating with said first seat part;

movement means for moving in a vertical direction one of said seat parts from a first position to a second position, said second seat part being positioned about said first seat part in said first position and below said first seat part in said second position; and guide members mounted to a wall proximate said sanitary seat assembly for guiding said sanitary seat assembly during vertical movement.

3. A sanitary seat assembly for providing a sitting place for a human body to facilitate washing of lower parts, which comprises:

a first seat part;

a second seat part cooperating with said first seat part;

movement means for moving in a vertical direction one of said seat parts from a first position to a second position, said second seat part being positioned above said first seat part in said first position and below said first seat part in said second position, said seat parts tilt forward in a vertical direction during upward movement to facilitate seating of said human body.

4. A sanitary seat assembly for providing a sitting place for a human body to facilitate washing of lower parts, which comprises:

a first seat part;

a second seat part cooperating with said first seat part;

movement means for moving in a vertical direction one of said seat parts from a first position to a second position, said second seat part being positioned above said first seat part in said first position and below said first seat part in said second position, said first and said second seat parts being positioned at essentially a same height; and a locking means for locking said first seat and said second seat parts in an uppermost position of said seat parts.

5. A sanitary seat assembly as defined in claims 1, 2, 3 or 4 wherein said movement means moves said seat part in a vertical direction.

* * * * *